US011459686B2

(12) United States Patent
Kim et al.

(10) Patent No.: US 11,459,686 B2
(45) Date of Patent: Oct. 4, 2022

(54) WASHING MACHINE, CONTROL METHOD OF WASHING MACHINE AND SERVER FOR SUPPORTING WASHING

(71) Applicant: LG ELECTRONICS INC., Seoul (KR)

(72) Inventors: Sang Won Kim, Seoul (KR); Sejong Hyun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 172 days.

(21) Appl. No.: 16/853,254

(22) Filed: Apr. 20, 2020

(65) Prior Publication Data

US 2021/0189626 A1 Jun. 24, 2021

(30) Foreign Application Priority Data

Dec. 23, 2019 (KR) ..... 10-2019-0173336

(51) Int. Cl.

| | |
|---|---|
| ***D06F 34/18*** | (2020.01) |
| ***D06F 34/28*** | (2020.01) |
| ***D06F 33/36*** | (2020.01) |
| ***D06F 33/37*** | (2020.01) |
| ***D06F 33/40*** | (2020.01) |
| ***D06F 34/08*** | (2020.01) |
| ***D06F 105/54*** | (2020.01) |
| ***D06F 103/06*** | (2020.01) |
| ***D06F 101/06*** | (2020.01) |

(Continued)

(52) U.S. Cl.

CPC ..... *D06F 34/18* (2020.02); *D06F 33/36* (2020.02); *D06F 33/37* (2020.02); *D06F 33/40* (2020.02); *D06F 34/08* (2020.02); *D06F 34/28* (2020.02); *D06F 2101/06* (2020.02); *D06F 2103/06* (2020.02); *D06F 2105/42* (2020.02); *D06F 2105/48* (2020.02); *D06F 2105/54* (2020.02)

(58) Field of Classification Search

CPC ..... D06F 34/18; D06F 2103/02

See application file for complete search history.

(56) References Cited

U.S. PATENT DOCUMENTS

| | | | | |
|---|---|---|---|---|
| 2016/0060800 | A1* | 3/2016 | Ghosh | D06F 33/34 68/12.23 |
| 2020/0134806 | A1* | 4/2020 | Kessler | G06Q 10/06316 |
| 2021/0140091 | A1* | 5/2021 | Choi | G06V 10/751 |

FOREIGN PATENT DOCUMENTS

| | | | |
|---|---|---|---|
| KR | 10-0180341 | B | 5/1999 |
| KR | 10-2011-0023063 | A | 3/2011 |

* cited by examiner

*Primary Examiner* — Spencer E. Bell

(74) *Attorney, Agent, or Firm* — Birch, Stewart, Kolasch & Birch, LLP

(57) ABSTRACT

Disclosed is a washing machine that performs a washing process in response to a type of a contaminant in laundry in a 5G environment, a method for controlling a washing machine, and a server for supporting washing. The washing machine according to an embodiment of the present disclosure may include a processor, a memory operably coupled to the processor and for storing at least one code executed in the processor, and a driver for controlling rotation of an inner tub so as to perform a washing operation on laundry. The memory may store a code to, when executed by the processor, cause the processor to identify a type of a contaminant in the laundry, determine a first washing process corresponding to the type of the contaminant, and control the driver based on the first washing process.

14 Claims, 8 Drawing Sheets

(51) Int. Cl.
*D06F 105/42* (2020.01)
*D06F 105/48* (2020.01)

FIG. 4

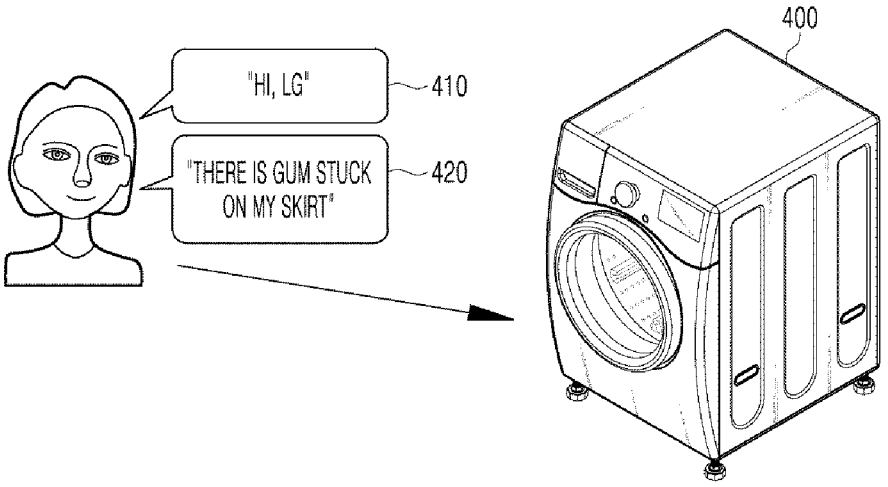

430

| GARMENT TYPE | TYPE OF CONTAMINANT | WASHING PROCESS |
|---|---|---|
| SKIRT | GUM | SETTINGS: STANDARD COURSE AND RINSING TWICE; 40-DEGREE WATER TEMPERATURE; AND 25 MILLILITER HIGH CONCENTRATION LIQUID DETERGENT |
| DRESS SHIRT | SOY SAUCE | SETTINGS: STANDARD COURSE AND RINSING TWICE; 40-DEGREE WATER TEMPERATURE; AND 25 MILLILITER HIGH CONCENTRATION LIQUID DETERGENT |
| SWEATER | KIMCHI | SETTINGS: LINGERIE WOOL COURSE AND RINSING 3 TIMES; COLD WATER TEMPERATURE; AND 20 MILLILITER COMMON LIQUID DETERGENT |
| ⋮ | | |

431

FIG. 5

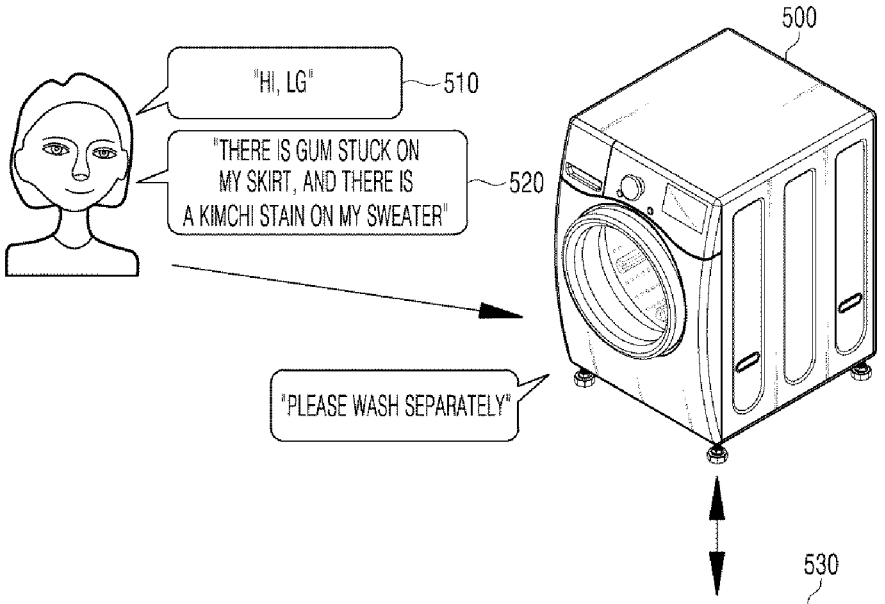

530

| GARMENT TYPE | TYPE OF CONTAMINANT | WASHING PROCESS |
|---|---|---|
| SKIRT | GUM | SETTINGS: STANDARD COURSE AND RINSING TWICE; 40-DEGREE WATER TEMPERATURE; AND 25 MILLILITER HIGH CONCENTRATION LIQUID DETERGENT |
| DRESS SHIRT | SOY SAUCE | SETTINGS: STANDARD COURSE AND RINSING TWICE; 40-DEGREE WATER TEMPERATURE; AND 25 MILLILITER HIGH CONCENTRATION LIQUID DETERGENT |
| SWEATER | KIMCHI | SETTINGS: LINGERIE WOOL COURSE AND RINSING 3 TIMES; COLD WATER TEMPERATURE; AND 20 MILLILITER COMMON LIQUID DETERGENT |
| ⋮ | | |

531

FIG. 6

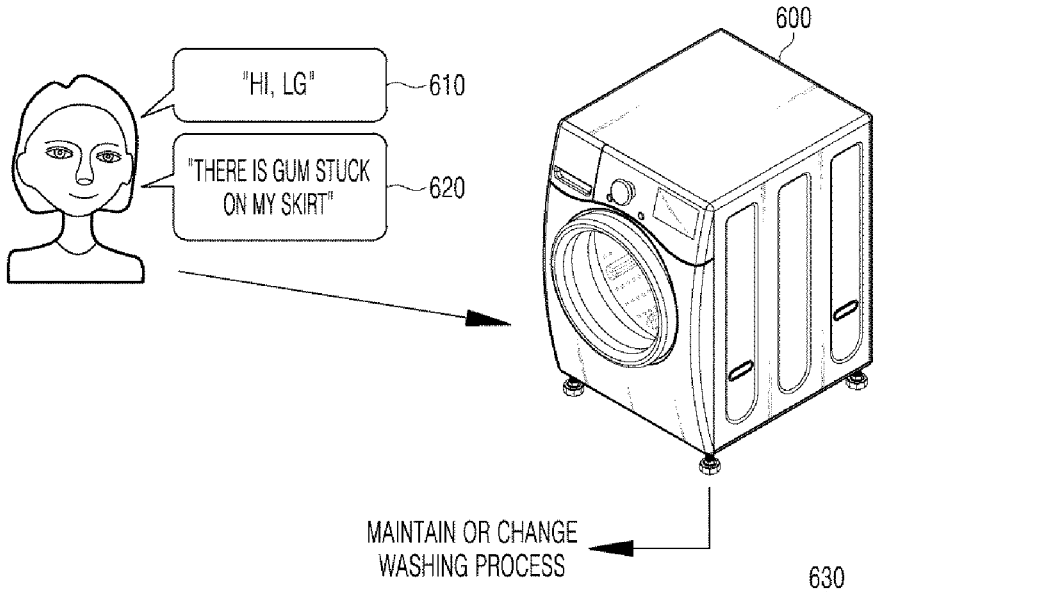

630

| GARMENT TYPE | TYPE OF CONTAMINANT | WASHING PROCESS |
|---|---|---|
| SKIRT | GUM | SETTINGS: STANDARD COURSE AND RINSING TWICE; 40-DEGREE WATER TEMPERATURE; AND 25 MILLILITER HIGH CONCENTRATION LIQUID DETERGENT |
| DRESS SHIRT | SOY SAUCE | SETTINGS: STANDARD COURSE AND RINSING TWICE; 40-DEGREE WATER TEMPERATURE; AND 25 MILLILITER HIGH CONCENTRATION LIQUID DETERGENT |
| SWEATER | KIMCHI | SETTINGS: LINGERIE WOOL COURSE AND RINSING 3 TIMES; COLD WATER TEMPERATURE; AND 20 MILLILITER COMMON LIQUID DETERGENT |
| ⋮ | | |

631

WASHING MACHINE, CONTROL METHOD OF WASHING MACHINE AND SERVER FOR SUPPORTING WASHING

CROSS-REFERENCE TO RELATED APPLICATION

This present application claims the benefit of priority to Korean Application No. 10-2019-0173336, entitled "WASHING MACHINE, CONTROL METHOD OF WASHING MACHINE AND SERVER FOR SUPPORTING WASHING," filed on Dec. 23, 2019, in Korean Intellectual Property Office, the entire disclosure of which is incorporated herein by reference.

BACKGROUND

1. Technical Field

The present disclosure relates to a washing machine for identifying a contaminant in laundry and washing the laundry based on a washing process corresponding to the contaminant.

2. Description of Related Art

A washing machine is an apparatus for washing laundry. When laundry is introduced into the washing machine and a washing start command is inputted, the washing machine may automatically determine, based on an amount (or volume, or weight) of the laundry, a washing process (for example, an operation course of the laundry such as wool washing, bedding washing, and standard washing, an amount of water, and the number of times of rinsing operations), or may receive a washing process from a user and operate according to the inputted washing process.

Here, the washing machine may automatically determine, without considering a contaminant, the washing process in the laundry or receive an input from the user. However, in this case, the contaminant in the laundry may not be cleanly removed.

Korean Patent Application Publication No. 10-2011-0023063 (hereinafter referred to as "Related Art 1") discloses a method for sensing an amount of laundry and calculating an amount of detergent based on the sensed amount of laundry. In addition, Korean Patent Registration No. 10-0180341 (hereinafter referred to as "Related Art 2") discloses a method for washing laundry while collecting contaminants that are separated from laundry and floating during washing by using an electric method, and allowing the collected contaminants to be discharged together with wash water during draining, thereby improving washing effect.

In Related Art 1, the amount of detergent may be calculated based on the amount of laundry, and the detergent may be dispensed into the laundry, thereby washing the laundry clean. In Related Art 2, the contaminants may be collected through the electric method, thereby easily discharging the contaminants.

However, Related Art 1 and Related Art 2 do not perform a washing process in consideration of contaminant in a laundry during washing, and thus contaminant of the laundry may not be removed cleanly.

Therefore, there is a need for a technique capable of effectively removing contaminant from laundry through a washing operation based on a washing process suitable for removing of the contaminant in the laundry.

SUMMARY OF THE INVENTION

Embodiments of the present disclosure are directed to effectively removing contaminant from laundry regardless of the type of contaminant through identifying the type of the contaminant in the laundry, and washing the laundry based on a washing process corresponding to the type of the contaminant, thereby washing the laundry clean.

Embodiments of the present disclosure are further directed to acquiring a washing process corresponding to a type of contaminant in laundry from an internal memory or a washing support server, thereby supporting the washing process capable of removing various contaminants.

Embodiments of the present disclosure are also directed to make it possible to wash the laundry clean in various washing ways through other routes (for example, a search engine) even when it is not possible to acquire the washing process corresponding to the type of the contaminant from the memory or the washing support server, by acquiring and outputting a washing method associated with the contaminant from a search server.

Embodiments of the present disclosure are additionally directed to make it possible to wash the laundry clean in various washing ways through other routes (for example, a search engine) even when it is not possible to acquire the washing process corresponding to the type of the contaminant from the memory or the washing support server, by changing the washing method found by the search server into a washing process that is performable by the washing machine, and transmitting the washing process to the washing machine.

Embodiments of the present disclosure are also directed to wash laundry based on a washing process (washing method) further corresponding to not only a type of a contaminant in the laundry but also laundry information (for example, a garment type of the laundry, a material type of the laundry, a color type of the laundry and an area of the contaminant), thereby effectively washing the laundry within a range that does not damage the laundry.

There is provided a washing machine according to an embodiment of the present disclosure. The washing machine may include an inner tube, a processor, a memory operably coupled to the processor and configured to store codes to be executed in the processor, and a driver configured to control rotation of the inner tub so as to perform a washing operation on laundry inserted into the inner tub. The memory may store a code configured to, when executed by the processor, cause the processor to identify a type of a contaminant in the laundry, determine a first washing process corresponding to the type of the contaminant, and control the driver based on the first washing process.

There is provided a washing support server according to another embodiment of the present disclosure. The washing support server may include a processor and a memory operably coupled to the processor and configured to store codes to be executed by processor. The memory may store a code configured to, when executed by the processor, cause the processor to search for a washing process in response to a request for transmission of a washing process corresponding to a type of a contaminant in laundry from a washing machine, and transmit the washing process to the washing machine in response to the request.

There is provided a washing machine control method performed by a washing machine including a processor, an inner tub and a driver for rotating the inner tub according to yet another embodiment of the present disclosure. The washing machine control method may include identifying, by the processor, a type of a contaminant in laundry and determining, by the processor, a washing process corresponding to the type of the contaminant, and controlling, by the processor, the driver to control rotation of the inner tub so as to perform a washing operation on the laundry based on the washing process.

In addition to these embodiments, another method and system for implementing the present disclosure, and a computer-readable recording medium storing a computer program for executing the method may be further provided.

The above and other aspects, features, and advantages of the present disclosure will become apparent from the detailed description of the following aspects in conjunction with accompanying drawings.

According to the present disclosure, a contaminant may be effectively removed from laundry regardless of the type of the contaminant through identifying the type of the contaminant in the laundry, and washing the laundry based on a washing process corresponding to the type of the contaminant, thereby washing the laundry clean.

According to the present disclosure, a washing process corresponding to a type of a contaminant in laundry may be acquired from an internal memory or a washing support server. However, in response to a result of the washing process not being acquired, a washing method associated with the type of the contaminant may be acquired and outputted from a search server, and the laundry may be washed based on a washing process corresponding to the washing method, thereby washing the laundry clean in various ways through other routes (for example, a search engine), even when it is not possible to acquire the washing process corresponding to the type of the contaminant from the memory or the washing support server.

Furthermore, according to the present disclosure, laundry may be washed based on a washing process (or washing method) further corresponding to not only a type of a contaminant in the laundry but also laundry information (for example, a garment type of the laundry, a material type of the laundry, a color type of the laundry, and an area of the contaminant), thereby effectively washing the laundry within a range that does not damage the laundry.

BRIEF DESCRIPTION OF THE DRAWINGS

The foregoing and other aspects, features, and advantages of the invention, as well as the following detailed description of the embodiments, will be better understood when read in conjunction with the accompanying drawings. For the purpose of illustrating the present disclosure, there is shown in the drawings an exemplary embodiment, it being understood, however, that the present disclosure is not intended to be limited to the details shown because various modifications and structural changes may be made therein without departing from the spirit of the present disclosure and within the scope and range of equivalents of the claims. The use of the same reference numerals or symbols in different drawings indicates similar or identical items.

FIG. 4 is a view illustrating an example of a washing operation performed by a washing machine according to an embodiment of the present disclosure.

FIG. 5 is a view illustrating another example of a washing operation performed by a washing machine according to an embodiment of the present disclosure.

FIG. 6 is a view illustrating another example of a washing operation performed by a washing machine according to an embodiment of the present disclosure.

DETAILED DESCRIPTION

Figure 1:
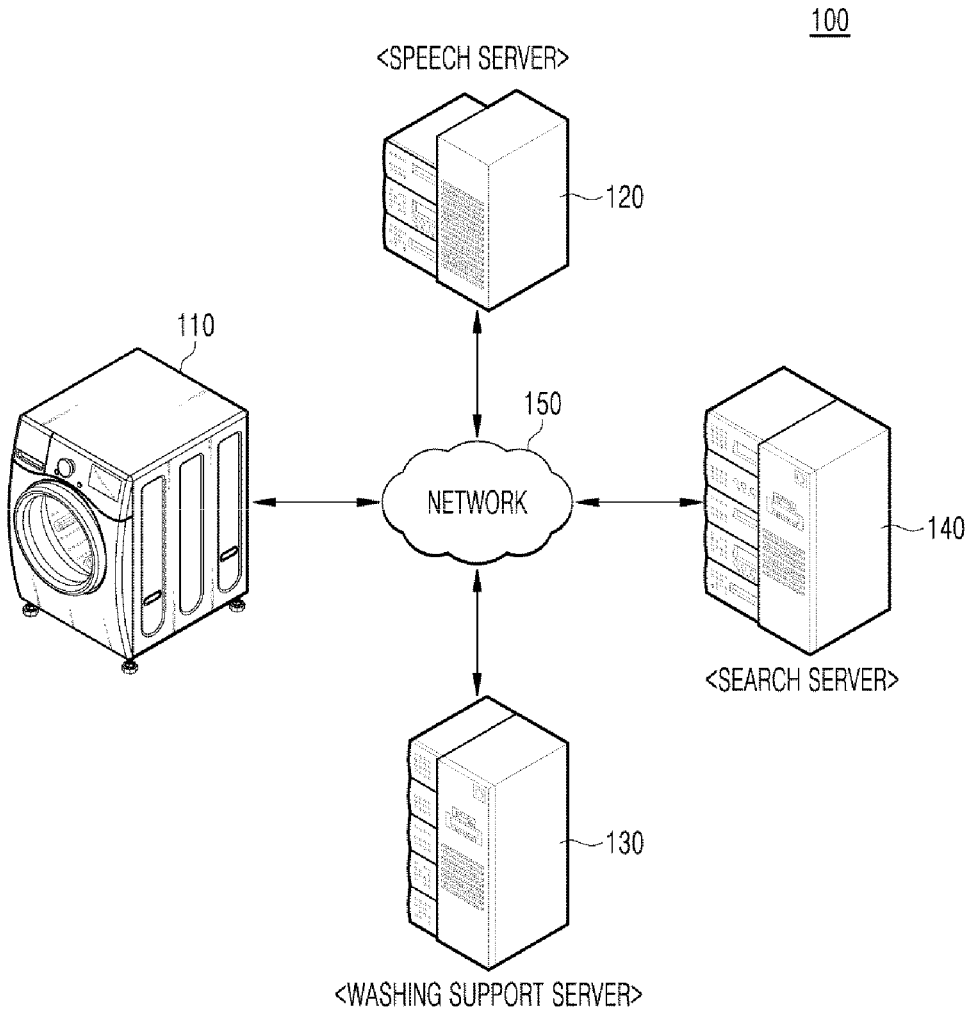
FIG. 1 is an exemplary view illustrating a washing machine system environment including a washing machine, a speech server, a washing support server, a search server, and a network connecting the washing machine, the speech server, the washing support server, and the search server to one another according to an embodiment of the present disclosure.

Advantages and features of the present disclosure and methods of achieving the advantages and features will be more apparent with reference to the following detailed description of example embodiments in connection with the accompanying drawings. However, the description of particular example embodiments is not intended to limit the present disclosure to the particular example embodiments disclosed herein, but on the contrary, it should be understood that the present disclosure is to cover all modifications, equivalents and alternatives falling within the spirit and scope of the present disclosure. The embodiments disclosed below are provided so that this disclosure will be thorough and complete and will fully convey the scope of the present disclosure to those skilled in the art. In the interest of clarity, not all details of the relevant art are described in detail in the present specification in so much as such details are not necessary to obtain a complete understanding of the present disclosure.

The terminology used herein is used for the purpose of describing particular example embodiments only and is not intended to be limiting. It must be noted that as used herein and in the appended claims, the singular forms "a," "an," and "the" include the plural references unless the context clearly dictates otherwise. The terms "comprises," "comprising," "includes," "including," "containing," "has," "having" or other variations thereof are inclusive and therefore specify the presence of stated features, integers, steps, operations, elements, and/or components, but do not preclude the presence or addition of one or more other features, integers, steps, operations, elements, components, and/or a combination thereof. Furthermore, these terms such as "first, " "second," and other numerical terms, are used only to distinguish one element from another element. These terms are generally only used to distinguish one element from another.

Hereinafter, embodiments of the present disclosure will be described in detail with reference to the accompanying drawings. Like reference numerals designate like elements throughout the specification, and overlapping descriptions of the elements will be omitted.

Hereinafter, a washing process used for a washing machine according to an embodiment of the present disclosure may include a series of all processes for washing such as a washing cycle, a rinsing cycle, and a spinning cycle. Specifically, the washing process includes at least one of a washing option (for example, the number of times of rinsing operations, the number of times of spinning operations, and washing temperature), a washing course (for example, a standard course, a wool course, and a bedding course), driving control of an inner tub, water spray control, a type of laundry detergent (for example, a common detergent, a highly-concentrated detergent, a powder detergent, and a liquid detergent), an amount of detergent, or an additional substance capable of removing a contaminant, and may be a series of driving processes in which the aforementioned elements are combined, or a control command for commanding the series of driving processes. When the washing process is the series of driving processes in which, for example, the washing option and the washing course, and the like are combined, the washing process may be referred to herein as a washing process list.

For example, the washing process may be a driving process in which a preset standard course, a 10 minute rinsing cycle, and a 5 minute spinning cycle are combined. The washing process may be a driving process in which both a tumbling operation wherein laundry falls as driving control of an inner tub for a washing course that is not preset, and a spin operation wherein the laundry rotates together with the inner tub, are performed alternately 50 times, or the washing process may be a control command for commanding the driving process.

FIG. 1 is an exemplary view illustrating a washing machine system environment including a washing machine, a speech server, a washing support server, a search server, and a network connecting the washing machine, the speech server, the washing support server, and the search server to one another according to an embodiment of the present disclosure.

Referring to FIG. 1, a washing machine system environment 100 may include a washing machine 110, a speech server 120, a washing support server 130, a search server 140, and a network 150.

The washing machine 110 is an apparatus configured to process laundry through various operations such as washing, spinning, and/or drying. The washing machine 110 may include, for example, a washing machine configured to remove contaminants from the laundry (hereinafter also referred to as "cloth") using water and detergent, a spinner configured to extract water from laundry by rotating a drum loaded with the wet laundry at high speed, a dryer configured to dry the laundry by supplying dry air into the drum loaded with the laundry, and a combined dryer and washing machine having both drying function and washing function. Detailed structure of the washing machine 110 will be described later with reference to FIG. 2.

The washing machine 110 may identify a type of a contaminant in laundry and wash the laundry based on a washing process corresponding to the type of the contaminant, thereby cleanly removing the contaminant from the laundry regardless of the type of the contaminant. First, the washing machine 110 may identify the type of the contaminant based on at least one of speech inputted via a microphone mounted in the washing machine 110 or an image of the laundry photographed by a camera mounted in the washing machine 110. Here, the microphone may be mounted invisibly, for example, in a hole within a front surface of the washing machine 110. In addition, the camera may be mounted, for example, inside the washing machine 110 (such as in the vicinity of a door).

When identifying the type of the contaminant from the speech inputted from a user via the microphone, the washing machine 110 may transmit the speech to the speech server 120 (or transmit the speech to the speech server 120 based on the recognition of a wake-up word from the speech), and receive a speech analysis result from the speech server 120, thereby identifying the type of the contaminant. Here, the speech analysis result may enable further identification of laundry information (for example, a garment type of the laundry, a material type of the laundry, a color type of the laundry, and an area of the contaminant) in addition to a particular keyword extracted from the speech (for example, a wake-up word) and the type of the contaminant.

When identifying the type of the contaminant from the image of the laundry photographed by the camera, the washing machine 110 may apply a contaminant recognition algorithm that is pre-stored in an internal memory or received from the washing support server 130 to the image, thereby identifying the type of the contaminant from the image. Here, the contaminant recognition algorithm may be a machine learning-based learning model that is pre-trained to recognize the type of the contaminant based on images of contaminants from a plurality of pieces of laundry having different materials.

Thereafter, based on the identification of the contaminant in the laundry, the washing machine 110 may acquire a washing process corresponding to the type of the contaminant from the internal memory or the washing support server 130, and may wash the laundry by controlling a driver configured to control rotation of the inner tub, so as to perform a washing operation on the laundry based on the washing process.

The speech server 120 may analyze the speech in response to the reception of the speech from the washing machine 110 and provide a speech analysis result to the washing machine 110, thereby recognizing the type of the contaminant and laundry information uttered in the speech. In this case, the speech server 120 may apply a speech analysis algorithm to the speech received from the washing machine 110 to extract the speech analysis result. Here, the speech analysis algorithm may be a machine learning-based learning model that is pre-trained to analyze a keyword or sentence based on the speech.

The washing support server 130 may be, for example, an artificial intelligence (AI) server, and may be a database server that provides big data required for applying an AI algorithm (for example, a contaminant recognition algorithm) and various pieces of service information based on the big data.

Here, AI refers to a field of studying AI or a methodology for creating the same. Moreover, machine learning refers to a field of defining various problems dealing in an AI field and studying methodologies for solving the same. In addition, machine learning may be defined as an algorithm for improving performance with respect to a task through repeated experience with respect to the task.

An artificial neural network (ANN) is a model used in machine learning, and may refer in general to a model with problem-solving abilities, composed of artificial neurons (nodes) forming a network by a connection of synapses. The ANN may be defined by a connection pattern between neurons on different layers, a learning process for updating model parameters, and an activation function for generating an output value.

The ANN may include an input layer, an output layer, and optionally one or more hidden layers. Each layer includes one or more neurons, and the ANN may include synapses that connect the neurons to one another. In the ANN, each neuron may output a function value of the activation function with respect to input signals inputted through the synapse, weight, and bias.

A model parameter refers to a parameter determined through learning, and may include weight of synapse connection, bias of a neuron, and the like. Moreover, hyperparameters refer to parameters which are set before learning in a machine learning algorithm, and include a learning rate, a number of iterations, a mini-batch size, an initialization function, and the like.

The objective of training an ANN is to determine a model parameter for significantly reducing a loss function. The loss function may be used as an indicator for determining an optimal model parameter in a learning process of an ANN.

Machine learning may be classified into supervised learning, unsupervised learning, and reinforcement learning depending on the learning method.

Supervised learning may refer to a method for training the ANN with training data that has been given a label. In addition, the label may refer to a target answer (or a result value) to be inferred by the ANN when the training data is inputted to the ANN. Unsupervised learning may refer to a method for training an ANN using training data that has not been given a label. Reinforcement learning may refer to a learning method for training an agent defined within an environment to select an action or an action order for maximizing cumulative rewards in each state.

Machine learning of an ANN implemented as a deep neural network (DNN) including a plurality of hidden layers may be referred to as deep learning, and the deep learning is one machine learning technique.

The washing support server 130, which is an AI server, may train the contaminant recognition algorithm through deep learning by using, as training data, images of contaminants from a set number or above of pieces of laundry, and types of the contaminants. In addition, the washing support server 130 may further use the laundry information as the training data.

The washing support server 130 may transmit the contaminant recognition algorithm to the washing machine 110, and accordingly the washing machine 110 may recognize the contaminant in the laundry by using the contaminant recognition algorithm.

The washing support server 130 may be configured to include a processor and a memory. The processor in the washing support server 130 may search for a washing process from the internal memory in response to a request for transmission of the washing process corresponding to the type of the contaminant in the laundry from the washing machine 110, and may transmit the washing process to the washing machine 110 as a response to the request.

The memory in the washing support server 130 may be operably connected to the processor and store at least one code in association with an operation performed by the processor. In addition, the memory may further store at least one of a list about the washing process corresponding to the type of the contaminant (that is, a washing process list) or the contaminant recognition algorithm. Here, the washing process list may further include a washing process further corresponding to the laundry information, together with the type of the contaminant.

In addition, the processor in the washing support server 130 may request the search server 140 for a washing method associated with the type of the contaminant, based on a result of the washing process not being found in the memory, and may receive the washing method from the search server 140 as a response to the request and transmit the washing method to the washing machine 110.

The search server 140 may search for the washing method through a search engine (for example, a search site), based on receiving the request for the washing method associated with the type of contaminant in the laundry from the washing support server 130, and may transmit a search result to the washing support server 130 as a response to the request. In this case, the search server 140 may select, among the search results, a washing method that satisfies set conditions (for example, a washing method found in a first order, a washing method written in a blog with the most positive comments, such as (for example, "I like it." and "It works") and a recently written washing method), and may transmit the selected washing method to the washing support server 130.

When searching for the washing method associated with the type of the contaminant, the search server 140 may search for the washing method through the search engine by using the type of the contaminant as a keyword, but when a search result does not satisfy a set condition (for example, the number of search results is less than or equal to a set number of search results), the keyword may be changed and searched again.

The search server 140 may transmit, based on receiving the request for the washing method associated with the type of contaminant in the laundry from the washing support server 130, the washing method to the washing support server 130, thereby providing the washing method to the washing machine 110, but is not limited thereto. For example, the search server 140 may provide the washing method to the washing machine 110 based on directly receiving the request for the washing method associated with the type of contaminant in the laundry from the washing machine 110, or may provide the washing method to the washing machine 110 through the speech server 120 based on receiving the request for the washing method associated with the type of the contaminant in the laundry from the washing machine through the speech server 120.

The network 150 may connect the washing machine 110, the speech server 120, the washing support server 130, and the search server 140 to one another. The network 150 may include, but is not limited to, wired networks such as local area networks (LANs), wide area networks (WANs), metropolitan area networks (MANs), and integrated service digital networks (ISDNs), or wireless networks such as wireless LANs, CDMA, Bluetooth, satellite communications, and the like. Also, the network 150 may transmit or receive data using short distance communication and/or long distance communication. The short-range communication may include Bluetooth®, radio frequency identification (RFID), infrared data association (IrDA), ultra-wideband (UWB), ZigBee, and wireless-fidelity (Wi-Fi) technologies, and the long-range communication may include code division multiple access (CDMA), frequency division multiple access (FDMA), time division multiple access (TDMA), orthogonal frequency division multiple access (OFDMA), and single carrier frequency division multiple access (SC-FDMA).

The network 150 may include connection of network elements such as a hub, a bridge, a router, a switch, and a gateway. The network 150 may include one or more connected networks, including a public network such as the Internet and a private network such as a secure corporate private network. For example, the network may include a multi-network environment. Access to the network 150 can be provided via one or more wired or wireless access networks. Furthermore, the network 150 may support 5G communication and/or an Internet of things (IoT) network to exchanging and processing information between distributed components such as objects.

Figure 2:
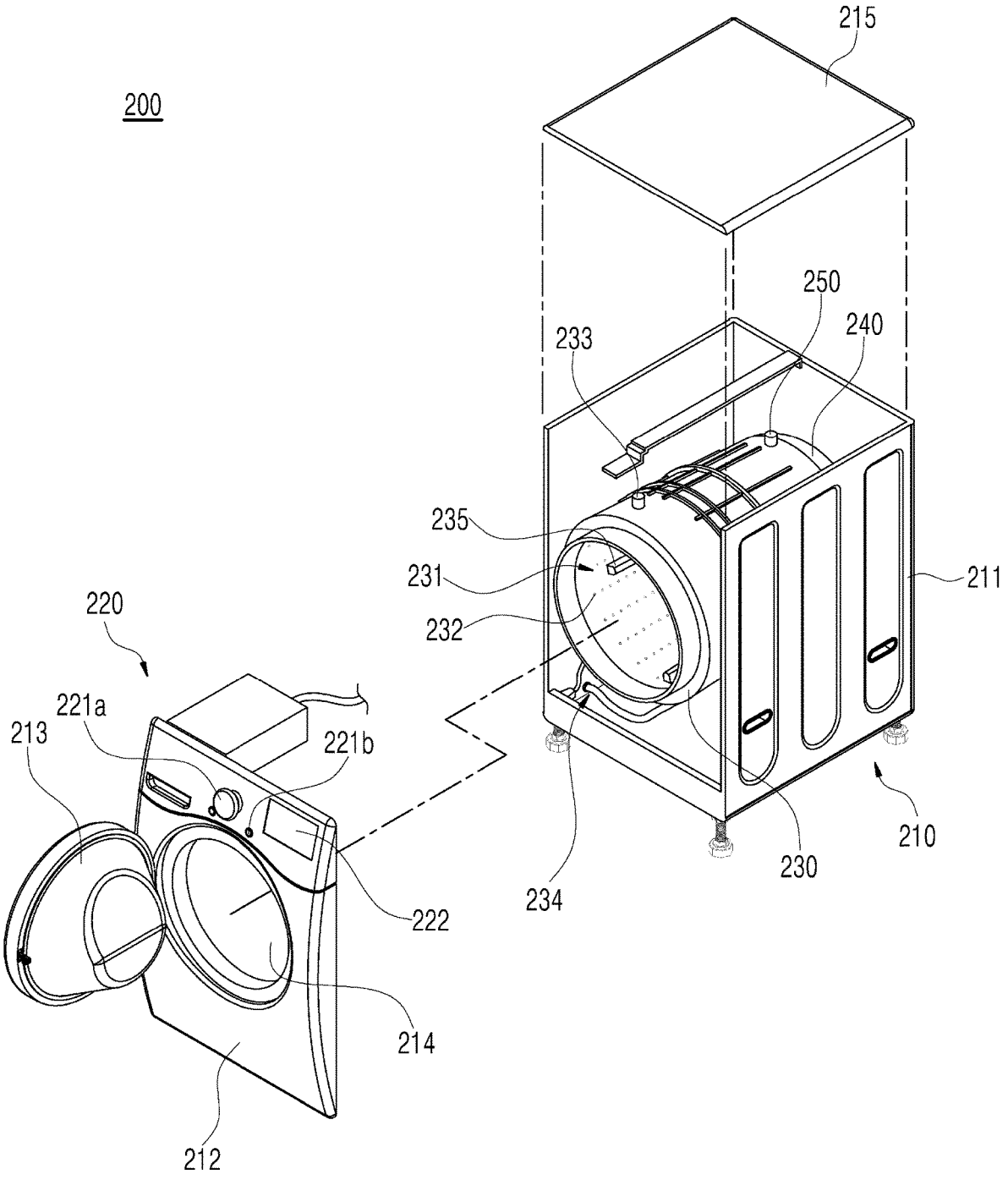
FIG. 2 is a schematic view illustrating a structure of a washing machine according to an embodiment of the present disclosure.

FIG. 2 is a schematic view illustrating a structure of a washing machine according to an embodiment of the present disclosure.

Referring to FIG. 2, a washing machine 200 may include a cabinet 210 forming an exterior, a tub 230 provided inside the cabinet 210 and supported by the cabinet 210, a drum 231 rotatably disposed inside the tub 230 (that is, an inner tub) and into which laundry is loaded, a driver 240 configured to rotate the drum by applying torque to the drum 231 (that is, an outer tub), a UI 220 configured to allow a user to select and execute a washing course, a sensing unit 250 configured to sense various information, and a temperature sensor configured to measure a temperature. In this case, the driver 240 may include, for example, a motor, and the UI 220 may include input interfaces 221*a* and 221*b* and an output interface 222.

Also, the cabinet 210 may include a main body 211, a cover 212 provided and coupled to the front surface of the main body 211, and a top plate 215 coupled to an upper portion of the main body 211. The cover 212 may include an opening 214 provided to enable loading and unloading of the laundry, and a door 213 that selectively opens and closes the opening 214. In addition, the drum 231 may be provided with a space for washing the laundry loaded therein, and may be rotated by receiving power from the driver 240. Also, the drum 231 may be provided with a plurality of through holes 232. Accordingly, wash water stored in the tub 230 may be introduced into the drum 231 through the through holes 232 and the wash water inside the drum 231 may flow into the tub 230. Therefore, when the drum 231 is rotated, the laundry loaded in the drum 231 may be decontaminated through rubbing process with the wash water stored in the tub 230. Meanwhile, the drum 231 may further include a lifter 235 configured to stir the laundry.

The UI 220 is configured to allow the user to input information related to washing (including the entire operation process of the washing machine) as well as to check the information related to washing. That is, the UI 220 is configured to interface with the user. Thus, the UI 220 may be configured to include input interfaces 221*a* and 221*b* for allowing the user to input a control instruction and an output interface 222 for displaying control information according to the control instruction. In addition, the UI 220 may include a controller configured to control driving of the washing machine 200, including the operation of the driver 240, according to the control instruction. In this embodiment, the UI 220 may refer to a control panel capable of input and output for the control of the washing machine 200. For this purpose, the UI 220 may be configured as a touch-sensitive display controller or various input/output controllers. As an example, the touch-sensitive display controller may provide an output interface and an input interface between the apparatus and the user. The touch-sensitive display controller may transmit and receive an electrical signal with the controller. Also, the touch-sensitive display controller may display visual output to the user, and the visual output may include texts, graphics, images, videos, and combination thereof. The UI 220 may be, for example, any display member such as an organic light emitting display (OLED) capable of touch recognition, a liquid crystal display (LCD), or a light emitting display (LED).

That is, in this embodiment, the UI 220 may perform a function of the input interface 121 that receive a predetermined control instruction so that the user may control the overall operation of the washing machine 200. Also, the UI 220 may perform a function of the output interface 122 that may display an operating state of the washing machine 200 under the control of the controller. In this embodiment, the UI 220 may display an operation mode setting and/or a recommendation result of the washing machine 200 in response to a type of load of the laundry in the washing machine 200. Also, the UI 220 may output content including a reason to change to the recommended course, a description of a situation in which cloth unwinding is inevitable due to UE occurrence, or the like.

Also, in this embodiment, the washing machine 200 may be provided with at least one water supply hose configured to guide water supplied from an external water source, such as a faucet, to the tub 230, and a water inlet 233 to control the at least one water supply hose. In addition, the washing machine 200 may be provided with a dispenser configured to supply additives such as detergent, fabric softener and the like, into the tub 230 or the drum 231. In the dispenser, the additives may be classified and accommodated according to their type. The dispenser may include a detergent container configured to contain the detergent and a softener container configured to contain the fabric softener. In addition, the washing machine 200 may be provided with water supply pipes configured to selectively guide the water supplied through the water inlet 233 to each container of the dispenser. The water inlet 233 may include a water supply valve configured to control each of the water supply pipes, and the water supply pipes may include respective water supply pipes to supply water to the detergent container and the fabric softener container, respectively.

Meanwhile, a drain hose 234 may include a drainage hole configured to discharge the water from the tub 230, and a pump configured to pump the discharged water. The pump may selectively perform a function of transporting the discharged water into a drain pipe and a function of transporting the discharged water into a circulation pipe. In this case, the water that is transported by the pump and guided along the circulation pipe may be referred to as circulating water. The pump may include an impeller configured to transport water, a pump housing in which the impeller is accommodated, and a pump motor configured to rotate the impeller. In the pump housing, an inlet port through which water is introduced, a drain discharge port configured to discharge the water transported by the impeller into the drain pipe, and a circulating water discharge port configured to discharge the water transported by the impeller into a circulation pipe may be formed. Here, the pump motor may be capable of forward/reverse rotation. That is, in this embodiment, the water may be discharged through the drain discharge port or discharged through the circulating water discharge port, according to the direction in which the impeller is rotated. This configuration may be implemented by appropriately designing a structure of the pump housing. Since this technique is well known, a detailed description thereof will be omitted.

Meanwhile, the pump is capable of varying a flow rate (or discharge water pressure), and for this purpose, the pump motor constituting the pump may be a variable speed motor capable of controlling the rotational speed. The pump motor may be a brushless direct current motor (BLDC motor), but is not limited thereto. A driver for controlling the speed of motor may be further provided, and the driver may be an inverter driver. The inverter driver may convert AC power to DC power and input it to the motor at a desired frequency. Also, the pump motor may be controlled by the controller, and the controller may be configured to include a Proportional-Integral Controller (PI controller), a Proportional-Integral-Derivative Controller (PID controller) or the like. The controller may receive an output value (for example, output current) of the pump motor, and control the output value of the driver so that revolution per minute of the pump motor follows a predetermined target revolution per minute based the received value. Also, the controller may control the overall operation of the washing machine as well as the pump motor.

Meanwhile, in this embodiment, the washing machine 200 may include at least one balancer, in the front of the tub 230, along the circumference of the inlet of the tub 230. The balancer is for reducing vibration of the tub 230 and is a weight having a predetermined weight, and may be provided in plurality. For example, the balancers may be provided at the bottom of the front of the tub 230 as well as both the left and right sides of the front of the tub 230.

The sensing unit 250 may be configured to include a motor driving current sensor and a drum rotational speed sensor. In addition, the sensing unit 250 may further include a sensor configured to sense chemicals remaining in the wash water, an olfactory sensor configured to sense contaminated laundry, and the like, among the sensors not illustrated. In addition, foreign matter or the like included in the laundry may be sensed through a reflected wave by a wave sensor. For example, when the laundry includes metal such as a coin or the like, the foreign matter such as a coin or the like may be sensed by using characteristics of the reflected wave of the wave sensor. The motor driving current sensor may sense a driving current of the motor, and the drum rotation speed sensor may sense the rotation speed of the drum and output sensing data based on sensing the type of laundry.

The washing machine 200 may identify a type of a contaminant in laundry, and may wash the laundry based on a washing process corresponding to the type of the contaminant, thereby cleanly removing the contaminant from the laundry regardless of the type of the contaminant.

Figure 3:
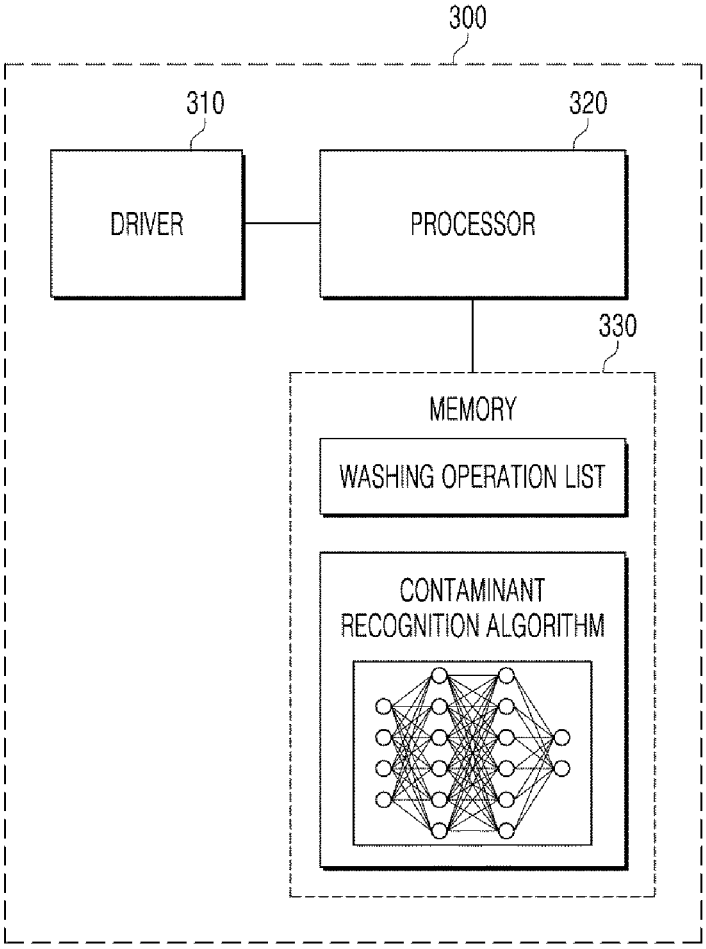
FIG. 3 is a schematic view illustrating an internal configuration of a washing machine according to an embodiment of the present disclosure.

FIG. 3 is a schematic view illustrating an internal configuration of a washing machine according to an embodiment of the present disclosure.

Referring to FIG. 3, a washing machine 300 according to an embodiment of the present disclosure may include a driver 310, a processor 320, and a memory 330.

The driver 310 may control rotation of an inner tub to perform a washing operation on laundry.

The processor 320 may identify a type of a contaminant in the laundry, determine a first washing process corresponding to the type of the contaminant, and control the driver 310 based on the first washing process, thereby washing the laundry. As a result, the processor 320 may effectively remove the contaminant from the laundry regardless of the type of the contaminant, thereby making it possible to wash the laundry clean.

In this case, the processor 320 may identify the type of the contaminant based on at least one of speech inputted via a microphone mounted in the washing machine or an image of the laundry photographed by a camera mounted in the washing machine.

When identifying the type of the contaminant based on the speech inputted from a user via the microphone, the processor 320 may analyze the speech and identify the type of the contaminant based on an analysis result.

Specifically, when identifying the type of the contaminant from the speech, the processor 320 may identify, based on the recognition of a particular keyword (for example, a wake-up word "Hi, LG.") from the speech, the type of the contaminant based on another keyword or sentence inputted together with the particular keyword (or inputted within a time period that is set based on an input time point of the particular keyword). That is, the processor 320 may identify, in response to the recognition of the wake-up word from the speech inputted through the microphone, the type of the contaminant based on the speech.

When identifying the type of the contaminant from the image, the processor 320 may apply a contaminant recognition algorithm to the image of the laundry photographed by the camera mounted in the washing machine so as to identify the type of the contaminant from the image. Here, the contaminant recognition algorithm may be a machine learning-based learning model that is pre-trained to recognize the type of the contaminant based on images of contaminants of a plurality of pieces of laundry having different materials, and may be pre-stored in the memory 330 or received from a washing support server.

In addition, the processor 320 may further identify, based on at least one of the speech or the image, laundry information in addition to the type of the contaminant. Here, the laundry information may include at least one of a garment type of the laundry (for example, a dress shirt, a T-shirt, and pants), a material type of the laundry (for example, cotton and nylon), a color type of the laundry (for example, white and black), or an area of the contaminant. For example, the processor 320 may identify, based on the recognition of the wake-up word from the speech inputted through the microphone, the garment type of the laundry together with the type of the contaminant from the speech.

In addition, the processor 320 may estimate a color of the contaminant, based on a result of the type of the contaminant (for example, soy sauce) being identified from the speech inputted via the microphone mounted in the washing machine. In this case, the processor 320 may determine a similarity between a color of the laundry identified from the image of the laundry photographed by the camera mounted in the washing machine and the color of the contaminant, change a color depth based on the similarity, and determine an area of the contaminant based on the changed color depth. For example, when black-based laundry is contaminated with soy sauce which is black in color, the processor 320 may subdivide a classification step of a color depth for determining a black color to more accurately determine a size of a contamination area (or an amount of the contamination area). Specifically, the processor 320 may determine, based on a result of the color of the originally black-based laundry exceeding a color depth for a black color of "80", the color of the laundry as black, but when the black-based laundry is contaminated with soy sauce which is black in color, the color depth for the black color may be changed. That is, the processor 320 may determine, based on a result of the color of the black-based laundry exceeding the color depth for the black color of "80", and being less than a color depth for a black color of "90", the color of the laundry as black. Conversely, the processor 320 may determine, based on a result of the color of the black-based laundry being less than the color depth for the black color of "90", a portion in the laundry that exceeds the color depth for the black color of "90" as a contamination area contaminated with soy sauce. For another example, a color depth step for classifying the black color may consist of 10 steps, but when a preset color of the contaminant recognized from the speech inputted via the microphone is a black-based color and it is determined that the color of the laundry identified from the image of the laundry photographed by the camera mounted in the washing machine is the black-based color, the color depth step for classifying the black color may be changed to be further subdivided (for example, 15 steps). Therefore, even when the laundry is contaminated with a contaminant with a color similar to the color of the laundry, the processor 320 may accurately determine an area of the contaminant.

The processor 320 may determine a washing process based on the area of the contaminant. For example, when the area of the contaminant is large, a washing process of increasing a time period of a washing cycle, changing a water temperature, increasing an amount of detergent to be dispensed, or increasing the number of times of rinsing operations may be determined. Therefore, the washing process may be determined based on the area of the contaminant, thereby improving removal efficiency of the contaminant.

In addition, as another example for identifying laundry information, the processor 320 may identify, based on an image of a washing label of the laundry photographed by the camera mounted in the washing machine, laundry information comprising at least one of the garment type of the laundry (for example, a dress shirt, a T-shirt, and pants), the material type of the laundry (for example, cotton and nylon), or the color type of the laundry.

The processor 320 may inquire of the user about the type of the contaminant through a speaker mounted in the washing machine in response to a result of comparing the type of the contaminant identified from the speech inputted via the microphone mounted in the washing machine and the type of the contaminant identified from the image of the laundry photographed by the camera mounted in the washing machine. For example, the processor 320 may inquire of the user about the type of the contaminant in the laundry by outputting synthetic speech through the speaker mounted in the washing machine, based on a result of the type of the contaminant identified from the speech and the type of the contaminant identified from the image of the laundry photographed by the camera being different from each other, thereby more accurately recognizing the type of the contaminant in the laundry.

In addition, the processor 320 may inquire of the user about, in response to a result of identifying, based on the speech, the garment type of the laundry together with the type of the contaminant, laundry information comprising at least one of the type of the contaminant or the garment type of the laundry through the speaker mounted in the washing machine. For example, the process 320 may inquire of the user about the laundry information based on a result of laundry information comprising at least one of the type of the contaminant or the garment type of the laundry not being recognized from the speech. That is, when the processor 320 fails to recognize the type of the contaminant or the garment type of the laundry from the speech uttered by the user, or the user does not utter the speech, the processor 320 may output synthetic speech through the speaker mounted in the washing machine to inquire of the user about the type of the contaminant or the type of garment of the laundry. In addition, when the garment type of the laundry is not found in a preset garment type item of a washing process list stored in the memory 330, the processor 320 may output synthetic speech through the speaker mounted in the washing machine to inquire of the user about the garment type of the laundry.

When determining the first washing process corresponding to the type of contaminant in the laundry, the processor 320 may determine the final first washing process by setting, for example, an inner tub driving process and a water spray control process of each cycle (for example, a washing cycle, a rinsing cycle, and a spinning cycle) in the first washing process, or may acquire and determine the first washing process that is preset to correspond to the type of the contaminant.

In this case, the processor 320 may determine, based on a washing process determination algorithm stored in the memory 330, each cycle in the first washing process Here, the washing process determination algorithm may be a machine learning-based learning model that is pre-trained to determine each cycle in the washing process based on the contamination of the laundry, and may be stored in the memory 330 or received from the washing support server. In addition, the processor 320 may acquire and determine the first washing process from the washing process list stored in the memory 330 or the washing support server.

In addition, the processor 320 compares, in response to a result of the type of the contaminant in the laundry being identified as being plural in number, first washing processes respectively corresponding to a plurality of types of contaminants, and may suggest, based on a comparison result, separate washing of the laundry through the speaker mounted in the washing machine. That is, the processor 320 may suggest, in response to a result of types of contaminants being respectively identified with respect to a plurality of pieces of laundry, and the first washing processes respectively corresponding to the plurality of types of contaminants being different from each other, separate washing of the plurality of pieces of laundry. Conversely, when, based on a result of a plurality of types of contaminants being identified in one piece of laundry, washing processes respectively corresponding to the plurality of types of contaminants are the same as each other, the processor 320 may wash the laundry through the same first washing process or wash the laundry through a relatively powerful first washing process among the respective washing processes. In this case, the processor 320 may determine, for example, that a standard course is stronger than a wool course, and the relatively powerful first washing process has the higher number of times of rinsing operations and spinning operations, and a higher water temperature.

Here, the processor 320 may request a search server for a washing method associated with the type of the contaminant, in response to a result of the first washing process being acquired from the memory 330 or the washing support server, and may acquire the washing method from the search server as a response to the request. In this case, the processor 320 may acquire, from the search server, a washing method that is selected among search results by satisfying set conditions (for example, a washing method found in a first order, a washing method written in a blog with the most positive comments (for example, "I like it." and "It works."), and a recently written washing method).

Thereafter, the processor 320 or the washing support server 130 may determine the first washing process based on the washing method acquired from the search server, and the processor 320 may control driving of the washing machine 110 based on the first washing process. In this case, when an additional substance capable of removing the contaminant in the washing method is identified, the processor 320 may determine the first washing process based on the additional substance, but is not limited thereto. Here, the processor 320 may identify, for example, the first washing process corresponding to the additional substance in the washing process list stored in the memory 330, but when it is not identified, the processor 320 may determine a washing process that is set as the first washing process.

In addition, the processor 320 may start control of the driver 310 based on a second washing process before identifying the type of the contaminant, determine the first washing process based on the type of the contaminant identified from the speech inputted via the microphone (or the image photographed by the camera), and compare the first washing process and the second washing process. In this case, the processor 320 may maintain, based on a result of determining that the first washing process and the second washing process are the same, the control of the driver 310 based on the second washing process (that is, the first washing process). Conversely, the processor 320 may change, based on a result of determining that the first washing process and the second washing process being different from each other, the second washing process into the first washing process, and may control the driver 310 based on the first washing process.

As a result, the processor 320 may identify the type of the contaminant even after a washing operation is started based on the second washing process (that is, during washing), and may wash the laundry based on the first washing process corresponding to the type of the contaminant.

In this case, as another example, the processor 320 may limit a time period or a step to allow the type of the contaminant to be identified. For example, the processor 320 may control, based on the type of the contaminant identified within a time period that is set based on a time point when the control of the driver 310 is started or identified before a cycle step (for example, a rinsing cycle step) that is set during the second washing process, the driver 310 on the basis of the washing process based on the type of the contaminant. Conversely, even when the type of the contaminant is identified after the set time period has elapsed or after the set cycle step, the processor 320 may maintain the controlling of the driver 310 based on the second washing process performed before identifying the type of the contaminant, thereby preventing an unnecessary cycle from being repeated due to a change in the washing process, despite the ineffectiveness in terms of removal of the contaminant.

In addition, the processor 320 may identify the type of the contaminant when a state of the washing machine is switched to a locked state. Thereafter, the processor 320 may unlock the locked washing machine in response to a result of determining that the first washing process (or washing method) includes an additional substance capable of removing the contaminant or includes a pre-processing process for removing the contaminant, thereby facilitating an action of dispensing the additional substance or taking out the laundry for pre-processing.

The processor 320 may acquire and determine the first washing process corresponding to the type of the contaminant from the memory 330 or the washing support server, but is not limited thereto, and the processor 320 may acquire and determine the first washing process further corresponding to the laundry information (for example, the first washing process corresponding to the type of the contaminant and the garment type of the laundry) together with the type of the contaminant, from the memory 330 or the washing support server.

In addition, in the same way as the first washing process, the processor 320 may search for a washing method associated with the laundry information together with the type of the contaminant (for example, a washing method associated with the type of the contaminant and the garment type of the laundry), and may acquire, from the search server, a washing method that is selected by satisfying a set condition among search results acquired from the search server, as a response to the request.

The processor 320 may wash the laundry based on the first washing process corresponding to the laundry information together with the type of the contaminant (or the washing method associated with the laundry information together with the type of the contaminant), thereby more effectively washing the laundry within a range that does not damage the laundry.

The memory 330 may be operably connected with the processor 320 and store at least one code in association with an operation performed by the processor. In addition, the memory may further store at least one of a list about the washing process corresponding to the type of the contaminant (that is, the washing process list), the contaminant recognition algorithm, or the washing process determination algorithm.

In addition, the memory 330 may perform a function of temporarily or permanently storing data processed by the processor 320. Herein, the memory 330 may include magnetic storage media or flash storage media, but the scope of the present disclosure is not limited thereto. The memory 330 may include an internal memory and/or an external memory and may include a volatile memory such as a DRAM, a SRAM or a SDRAM, and a non-volatile memory such as one time programmable ROM (OTPROM), a PROM, an EPROM, an EEPROM, a mask ROM, a flash ROM, a NAND flash memory or a NOR flash memory, a flash drive such as an SSD, a compact flash (CF) card, an SD card, a Micro-SD card, a Mini-SD card, an XD card or memory stick, or a storage device such as a HDD.

FIG. 4 is a view illustrating an example of a washing operation performed by a washing machine according to an embodiment of the present disclosure.

Referring to FIG. 4, a washing machine 400 according to an embodiment of the present disclosure may identify a garment type of introduced laundry and a type of a contaminant in the laundry, determine a washing process corresponding to the garment type of the laundry and the type of the contaminant, and wash the laundry based on the washing process.

In this case, the washing machine 400 may identify, in response to the input of speech uttered by a user through a microphone and the recognition of a wake-up word from the speech, the type of the contaminant based on the speech. For example, the washing machine 400 may recognize, based on "Hi, LG." 410 being recognized as the wake-up word from the speech inputted through the microphone, a sentence of "There is gum stuck on my skirt" 420 following the "Hi, LG." 410, and may identify therefrom that a garment type of laundry is "skirt" and a type of a contaminant is "gum".

The washing machine 400 may acquire a washing process ("settings: standard course and rinsing twice; 40-degree water temperature; and 25 milliliter high concentration liquid detergent") 431 corresponding to "skirt" and "gum" from a washing process list 430 stored in an internal memory, and may wash "skirt with gum stuck thereon" based on the washing process 431.

The washing machine 400 may acquire, based on a result of a washing process list 430 being not pre-stored in the internal memory or a washing process corresponding to "skirt" and "gum" being not acquired from the washing process list 430, the washing process corresponding to "skirt" and "gum" via a network from a washing support server.

FIG. 5 is a view illustrating another example of a washing operation performed by a washing machine according to an embodiment of the present disclosure.

Referring to FIG. 5, a washing machine 500 according to an embodiment of the present disclosure may compare, in response to a result of a type of a contaminant in introduced laundry being identified as a plurality, washing processes respectively corresponding to the plurality of types of contaminants, and may suggest, based on a comparison result, separate washing of the laundry through a speaker mounted in the washing machine 500.

In this case, the washing machine 500 may identify, in response to the input of speech uttered by the user through a microphone and the recognition of a wake-up word from the speech, the types of the contaminants based on the speech. For example, the washing machine 500 may recognize, based on "Hi, LG." 510 recognized as the wake-up word from the speech inputted through the microphone, a sentence of "There is gum stuck on my skirt, and there is a kimchi stain on my sweater" 520 following the "Hi, LG." 510, and may identify therefrom that garment types of a plurality of pieces of laundry are "skirt" and "sweater", and the types of the contaminants are "gum" and "kimchi" respectively with respect to "skirt" and "sweater".

The washing machine 500 may acquire, from a washing process list 530 stored in an internal memory, a washing process_#1 ("settings: standard course and rinsing twice; 40-degree water temperature; and 25 milliliter high concentration liquid detergent") 531 corresponding to "skirt" and "gum", and a washing process_#2 ("settings: lingerie wool course and rinsing 3 times; cold water temperature; and 20 milliliter common liquid detergent") 532 corresponding to "sweater" and "kimchi", and may suggest, in response to a result of the washing process_#1 531 and the washing process_#2 532 being different from each other, separate washing of "skirt with gum stuck thereon" and "sweater with a kimchi stain thereon".

FIG. 6 is a view illustrating another example of a washing operation performed by a washing machine according to an embodiment of the present disclosure.

Referring to FIG. 6, a washing machine 600 according to an embodiment of the present disclosure may wash laundry based on a second washing process performed before identifying a garment type of introduced laundry and a type of a contaminant in the laundry. Thereafter, the washing machine 600 may identify the garment type of the laundry and the type of the contaminant in the laundry from speech inputted via a microphone, determine a first washing process based on the identified garment type of the laundry and type of the contaminant in the laundry, and compare the first washing process and the second washing process.

For example, the washing machine 600 may wash the laundry based on a preset washing process (for example, "settings: standard course and rinsing twice; 40-degree water temperature; and 25 milliliter high concentration liquid detergent"), as a second washing process.

Thereafter, the washing machine 600 may recognize, based on "Hi, LG."610 recognized as a wake-up word from speech inputted via a microphone, a sentence of "There is gum stuck on my skirt" 620 following the "Hi, LG." 610, and may acquire a first washing process ("settings: standard course and rinsing twice; 40-degree water temperature; and 25 milliliter high concentration liquid detergent") 631 corresponding to "skirt" and "gum" from a washing process list 630 stored in an internal memory.

The washing machine 600 may wash, based on a result of determining that the first washing process 631 and the second washing process are the same as each other, "skirt with gum stuck thereon" based on the second washing process (that is, the first washing process).

Conversely, when the second process is "settings: lingerie wool course and rinsing once; 20-degree water temperature; and 20 milliliter common liquid detergent", the washing machine 600 may change, based on a result of determining that the first washing process 631 and the second washing process are different from each other, the second washing process into the first washing process 631, and may wash "skirt with gum stuck thereon" based on the first washing process 631.

As a result, the washing machine 600 may identify the type of the contaminant even after a washing operation is started based on the second washing process (that is, during washing), and may wash the laundry based on the first washing process corresponding to the type of the contaminant.

In FIGS. 4 to 6, the washing process lists 430, 530, and 630 each may include a washing process corresponding to a garment type of laundry and a type of a contaminant in the laundry, but are not limited thereto. For example, the washing process lists 430, 530, and 630 each may include a washing process corresponding to at least one of the garment type of the laundry, the contaminant in the laundry, a material type of the laundry, a color type of the laundry, an area of the contaminant, or an amount of the laundry.

In addition, the laundry process lists 430, 530, and 630 each may be included in a memory provided in the washing machine 400 or may be included in a washing support server.

Figure 7:
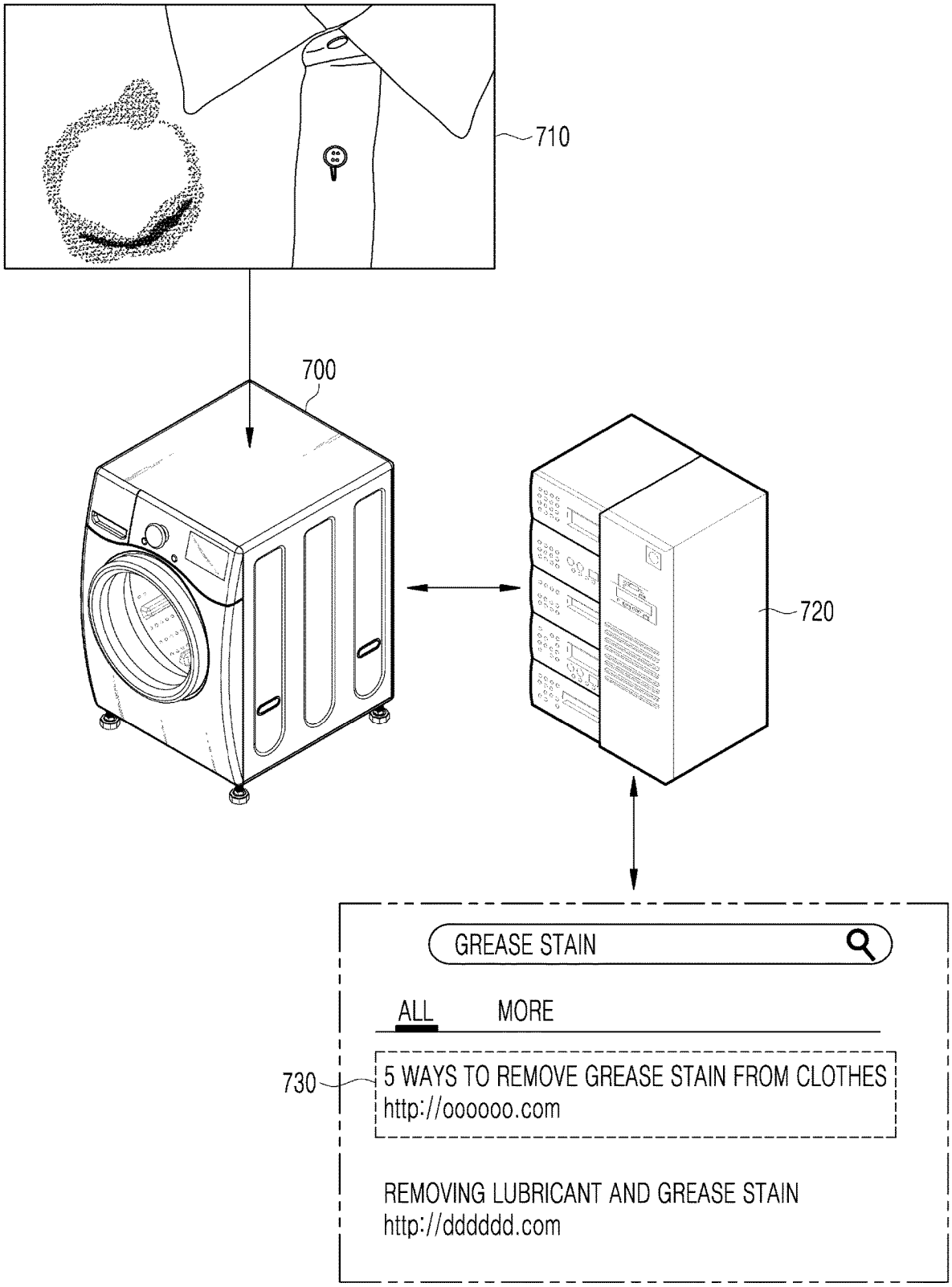
FIG. 7 is a view illustrating another example of a washing operation performed by a washing machine according to an embodiment of the present disclosure.

FIG. 7 is a view illustrating another example of a washing operation performed by a washing machine according to an embodiment of the present disclosure.

Referring to FIG. 7, a washing machine 700 according to an embodiment of the present disclosure may identify a garment type of introduced laundry and a type of a contaminant in the laundry, determine a washing process corresponding to the garment type of the laundry and the type of the contaminant, and wash the laundry based on the washing process.

In this case, the washing machine 700 may identify, for example, "dress shirt" and "grease" as the garment type of the laundry and the type of the contaminant in the laundry from an image 710 of the laundry photographed by a camera mounted in the washing machine 700. However, the washing machine 700 may request a search server 720 for a washing method associated with "dress shirt" and "grease", in response to a result of a washing process corresponding to "dress shirt" and "grease" not being acquired from an internal memory or a washing support server. The washing machine 700 may acquire, from the search server 720, the washing method (for example, when a grease stain is caused by greasy food, a method of "Try wiping the grease stain with cornstarch. Sprinkle the cornstarch on a stained portion to absorb grease, and then rub the stained portion with a toothbrush to make it even more effective"), as a response to the request, and may output synthetic speech.

Here, the washing machine 700 may acquire, from the search server 720, a washing method that is selected among search results by satisfying set conditions (for example, a first-order search result, a blog with a lot of comments, a recently written post, and the like). The washing machine 700 may acquire, for example, a washing method 730 of the first-order search result among the search results from the search server 720.

Thereafter, the washing machine 700 may determine a washing process based on the washing method acquired from the search server 720, and may wash the laundry based on the washing process. The washing process corresponding to various keywords of the washing method may be pre-stored or estimated by a pre-trained learning model. For example, the washing machine 700 or the washing support server may determine, based on a washing method characterized by washing the laundry after soaking the contaminant in hot water, a water temperature or soaking time period of a washing cycle, and may increase the number of times of tumbling operations based on a washing method characterized by rubbing the contaminant with a brush. In this case, for example, when an additional substance capable of removing the contaminant (for example, cornstarch) is identified in the washing method, the washing machine 700 may determine the washing process based on the additional substance, but is not limited thereto.

Figure 8:
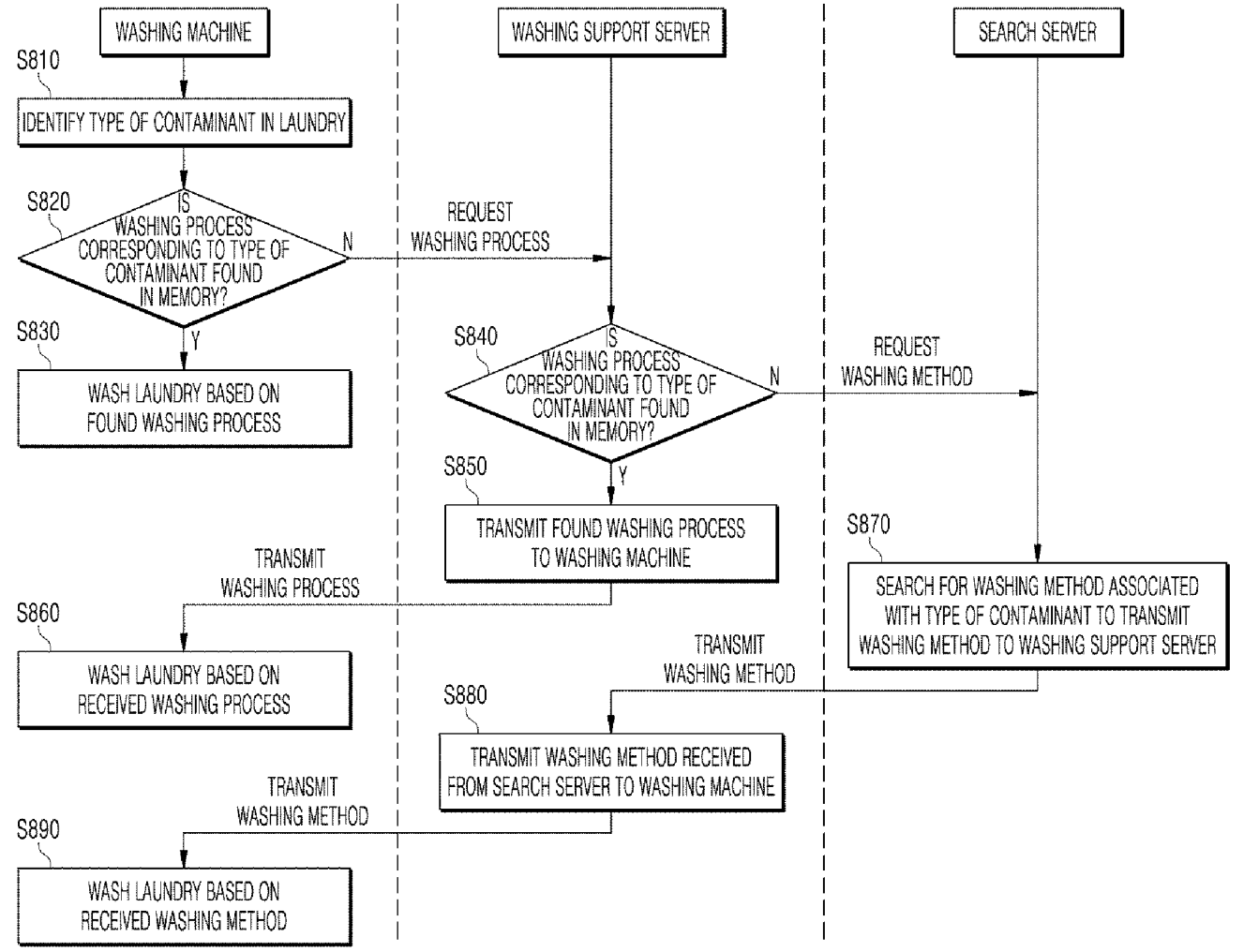
FIG. 8 is a flowchart illustrating a method for controlling a washing machine according to an embodiment of the present disclosure.

FIG. 8 is a flowchart illustrating a method for controlling a washing machine according to an embodiment of the present disclosure. Here, a washing machine implementing the method for controlling a washing machine according to the present disclosure may store at least one of a washing process list and a contaminant recognition algorithm in a memory. Here, the contaminant recognition algorithm may be a machine learning-based learning model that is pre-trained to recognize a type of a contaminant based on images of contaminants of a plurality of pieces of laundry having different materials.

Referring to FIG. 8, in step S810, the washing machine may identify a type of a contaminant in laundry. In this case, the washing machine may identify the type of the contaminant based on at least one of speech inputted via a microphone mounted in the washing machine and an image of the laundry photographed by a camera mounted in the washing machine.

When identifying the type of the contaminant from the speech inputted from a user via the microphone, the washing machine may analyze the speech and identify the type of the contaminant based on an analysis result.

Specifically, when identifying the type of the contaminant from the speech, the washing machine may identify, based on the recognition of a particular keyword (for example, a wake-up word "Hi, LG.") from the speech, the type of the contaminant based on another keyword or sentence inputted together with the particular keyword (or inputted within a time period that is set based on an input time point of the particular keyword). That is, the washing machine may identify, in response to the recognition of the wake-up word from the speech inputted through the microphone, the type of the contaminant from the speech.

When identifying the type of the contaminant from the image, the washing machine may apply the contaminant recognition algorithm to the image of the laundry photographed by the camera mounted in the washing machine, thereby identifying the type of the contaminant from the image.

In addition, the washing machine may further identify, based on at least one of the speech and the image, laundry information in addition to the type of the contaminant. Here, the laundry information may include at least one of a garment type of the laundry (for example, a dress shirt, a T-shirt and pants), a material type of the laundry (for example, cotton and nylon), a color type of the laundry (for example, white and black), or an area of the contaminant. For example, the washing machine may identify, based on the recognition of the wake-up word from the speech inputted through the microphone, the garment type of the laundry together with the type of the contaminant, from the speech.

In addition, as another example for identifying the laundry information, the washing machine may identify, based on an image of a washing label of the laundry photographed by the camera mounted in the washing machine, the laundry information.

The washing machine may inquire about, in response to a result of identifying the garment type of the laundry together with the type of the contaminant, laundry information comprising at least one of the type of the contaminant or the garment type of the laundry through a speaker mounted in the washing machine. For example, the washing machine may inquire about the laundry information based on a result of laundry information comprising at least one of the type of the contaminant or the garment type of the laundry being not recognized from the speech. That is, when the washing machine fails to recognize the type of the contaminant or the garment type of the laundry from the speech uttered by the user, or the user does not utter the speech itself, the washing machine may output synthetic speech through the speaker mounted in the washing machine to inquire about the type of the contaminant or the garment type of the laundry. In addition, when the garment type of the laundry is not found in a preset garment type list, the washing machine may output the synthetic speech through the speaker mounted in the washing machine to inquire about the garment type of the laundry.

In step S820, the washing machine may search for a washing process corresponding to the type of the contaminant in the memory, and in step S830, based on the washing process being found in the memory, the washing machine may control a driver configured to control rotation of an inner tub so as to perform a washing operation on the laundry based on the found washing process, thereby washing the laundry.

The washing machine may compare, in response to a result of the type of the contaminant in the laundry being identified as a plurality, washing processes respectively corresponding to the plurality of types of contaminants, and may suggest, based on a comparison result, separate washing of the laundry through the speaker mounted in the washing machine. That is, the washing machine may suggest, in response to a result of types of contaminants being identified respectively with respect to a plurality of pieces of laundry, and first washing processes respectively corresponding to the plurality of types of contaminants being different from each other, separate washing of the plurality of pieces of laundry. Conversely, when, based on a result of a plurality of types of contaminants being identified in one piece of laundry, washing processes respectively corresponding to the plurality of types of contaminants are the same as each other, the washing machine may wash the laundry through the same washing process or wash the laundry through a relatively powerful washing process among the respective washing processes. Here, the washing machine may determine, for example, that a standard course is stronger than a wool course, and that the relatively powerful washing process has the higher number of times of rinsing operations and spinning operations, and a higher water temperature.

As another example, in step S820, the washing machine may transmit, based on the washing process not being found in the memory, a request for a washing process corresponding to the type of the contaminant to a washing support server.

In step S840, the washing support server may search for the washing process corresponding to the type of the contaminant in the memory in response to the request for the washing process corresponding to the type of the contaminant from the washing machine, and in step S850, based on the washing process being found in the memory, the washing support server may transmit the found washing process to the washing machine.

In step S860, the washing machine may control the driver based on the washing process received in response to the request for the washing process from the washing support server, thereby washing the laundry.

As another example, in step S840, the washing support server may transmit, based on the washing process not being found in the memory, a request for a washing method associated with the type of the contaminant to the search server In step S870, the search server may search for the washing method associated with the type of the contaminant through a search engine (for example, a search site) in response to the request for the washing method associated with the type of the contaminant from the washing support server, and may transmit the found washing method to the washing support server. In this case, the search server may transmit, to the washing support server, a washing method that is selected among search results on the search engine by satisfying set conditions (for example, a first-order search result, a blog with a lot of comments, a recently written post, and the like).

In step S880, the washing support server may transmit the washing method received from the search server to the washing machine.

In step S890, the washing machine may wash the laundry by controlling the driver based on the washing method received from the washing support server.

In addition, the washing machine may identify the type of the contaminant when a state of the washing machine is switched to a locked state. Thereafter, the washing machine may unlock the locked washing machine in response to a result of determining that the washing process (or washing method) includes an additional substance capable of removing the contaminant or includes a pre-processing process for removing the contaminant, thereby facilitating an action of dispensing the additional substance or taking out the laundry for pre-processing.

The washing machine may acquire the washing process corresponding to the type of the contaminant in the laundry from the memory or the washing support server or acquire the washing method associated with the type of the contaminant from the search server, and may wash the laundry based on the acquired washing process or washing method, but is not limited thereto. For example, the washing machine may acquire, from the memory or the washing support server, a washing process further corresponding to the laundry information together with the type of the contaminant or acquire, from the search server, a washing method further associated with the laundry information together with the type of the contaminant, and may wash the laundry based on the acquired washing process or washing method.

In addition, the washing machine may receive, based on a result of the washing process corresponding to the type of the contaminant in the laundry not being found in the memory or the washing process being not received from the washing support server, the washing method associated with the type of the contaminant from the search server through the washing support server, but is not limited thereto. For example, the washing machine may directly request the search server for the washing method associated with the type of the contaminant, based on a result of failing to acquire the washing process from the memory or the washing support server, and may receive the washing method from the search server as a response to the request.

The embodiments described above may be implemented through computer programs executable through various components on a computer, and such computer programs may be recorded in computer-readable media. In this case, examples of the computer-readable media may include, but are not limited to: magnetic media such as hard disks, floppy disks, and magnetic tape; optical media such as CD-ROM disks and DVD-ROM disks; magneto-optical media such as floptical disks; and hardware devices that are specially configured to store and execute program instructions, such as ROM, RAM, and flash memory devices.

The computer programs may be those specially designed and constructed for the purposes of the present disclosure or they may be of the kind well known and available to those skilled in the computer software arts. Examples of program code include both machine codes, such as produced by a compiler, and higher level code that may be executed by the computer using an interpreter.

As used in the present application (especially in the appended claims), the terms "a/an" and "the" include both singular and plural references, unless the context clearly states otherwise. Also, it should be understood that any numerical range recited herein is intended to include all sub-ranges subsumed therein (unless expressly indicated otherwise) and therefore, the disclosed numeral ranges include every individual value between the minimum and maximum values of the numeral ranges.

The order of individual steps in process claims according to the present disclosure does not imply that the steps must be performed in this order; rather, the steps may be performed in any suitable order, unless expressly indicated otherwise. In other words, the present disclosure is not necessarily limited to the order in which the individual steps are recited. All examples described herein or the terms indicative thereof ("for example," etc.) used herein are merely to describe the present disclosure in greater detail. Therefore, it should be understood that the scope of the present disclosure is not limited to the embodiments described above or by the use of such terms unless limited by the appended claims. Also, it should be apparent to those skilled in the art that various modifications, combinations, and alternations may be made depending on design conditions and factors within the scope of the appended claims or equivalents thereof.

The present disclosure is thus not limited to the example embodiments described above, and rather intended to include the following appended claims, and all modifications, equivalents, and alternatives falling within the spirit and scope of the following claims.

What is claimed is:

1. A washing machine, comprising:

an inner tub;

a processor;

a memory operably coupled to the processor, the memory configured to store codes to be executed in the processor; and a driver configured to control rotation of the inner tub so as to perform a washing operation on laundry inserted into the inner tub, wherein the memory stores a code configured to, when executed by the processor, cause the processor to:

identify a type of a contaminant in the laundry, determine a first washing process corresponding to the type of the contaminant, and control the driver based on the first washing process, wherein the washing machine further comprises:

a microphone configured to capture speech; and a camera configured to capture an image of the laundry, and wherein the memory further stores a code configured to cause the processor to:

identify the type of the contaminant based on the speech inputted via the microphone, and estimate a color of the contaminant based on a result of the type of the contaminant being identified from the speech inputted via the microphone, determine a similarity between a color of the laundry identified from the image of the laundry photographed by the camera and the color of the contaminant, change a color depth used for identifying the type of contaminant based on the similarity, and determine an area of the contaminant based on the changed color depth.

2. The washing machine according to claim 1, wherein the memory further stores a code configured to cause the processor to acquire and determine the first washing process from the memory.

3. The washing machine according to claim 2, wherein the memory further stores a code configured to cause the processor to:

request a search server for a washing method associated with the type of the contaminant, in response to a result of the first washing process not being acquired from the memory, and acquire the washing method from the search server as a response to the request.

4. The washing machine according to claim 3, wherein laundry information comprises at least one of a garment type of the laundry, a material type of the laundry, a color type of the laundry or an area of the contaminant, and wherein the memory further stores a code configured to cause the processor to:

request the search server for a washing method associated with the laundry information together with the type of the contaminant, and acquire, from the search server, a washing method that is selected by satisfying a set condition among search results acquired from the search server, as a response to the request.

5. The washing machine according to claim 1, wherein the memory further stores a code configured to cause the processor to:

further identify, based on at least one of the speech or the image, laundry information comprising at least one of a garment type of the laundry, a material type of the laundry, a color type of the laundry or an area of the contaminant, and determine the first washing process further in response to the laundry information.

6. The washing machine according to claim 1, wherein the memory further stores a code configured to cause the processor to:

start control of the driver based on a second washing process performed before identifying the type of the contaminant, determine the first washing process based on the type of the contaminant identified from the speech inputted via the microphone, and compare the first washing process to the second washing process.

7. The washing machine according to claim 1, further comprising:

a speaker, wherein the memory further stores a code configured to cause the processor to inquire about the type of the contaminant through the speaker, in response to a result of comparing a first type of the contaminant identified from speech inputted via the microphone and a second type of the contaminant identified from the image of the laundry captured by the camera.

8. The washing machine according to claim 1, further comprising:

a speaker, wherein the memory further stores a code configured to cause the processor to:

identify, in response to a wake-up word recognized from speech inputted via the microphone, a garment type of the laundry together with the type of the contaminant based on the speech, and determine the first washing process based on the type of the contaminant and the garment type of the laundry.

9. The washing machine according to claim 8, wherein the memory further stores a code configured to cause the processor to inquire about the type of the contaminant and the garment type of the laundry through the speaker, in response to a result of identifying the garment type of the laundry together with the type of the contaminant based on the speech.

10. The washing machine according to claim 1, wherein the camera is further configured to capture an image of a laundry label of the laundry, and wherein the memory further stores a code configured to cause the processor to:

further identify, based on the image of the laundry label captured by the camera, laundry information comprising at least one of a garment type of the laundry, a material type of the laundry or a color type of the laundry, and determine the first washing process based on the type of the contaminant and the laundry information.

11. The washing machine according to claim 1, further comprising a speaker, wherein the laundry includes a plurality of laundry items, wherein the identifying the type of the contaminant in the laundry comprises identifying a plurality of types of contaminants for the plurality of laundry items, wherein the determining the first washing process includes determining first washing processes respectively corresponding to the plurality of types of contaminants; and wherein the memory further stores a code configured to cause the processor to:

compare the first washing processes respectively corresponding to the plurality of types of contaminants, and suggest, based on a comparison result, separate washing of the plurality of laundry items through the speaker.

12. The washing machine according to claim 1, wherein the memory further stores a code configured to cause the processor to:

identify the type of the contaminant when a state of the washing machine is switched to a locked state, where a door of the washing machine is locked, and unlock the door of the locked washing machine in response to a result of determining that the first washing process comprises an additional substance capable of removing the contaminant or comprises a pre-processing process for removing the contaminant.

13. The washing machine according to claim 1, wherein the first washing process comprises at least one of a washing course, a type of laundry detergent, an amount of detergent, an additional substance capable of removing the contaminant, or a washing option comprising at least one of a number of times of rinsing operations, a number of times of spinning operations or a washing temperature.

14. The washing machine according to claim 1, wherein the memory further stores a code configured to cause the processor to apply a contaminant recognition algorithm to the image of the laundry captured by the camera, to identify the type of the contaminant from the image, and wherein the contaminant recognition algorithm is a machine learning-based learning model that is pre-trained to recognize a type of a contaminant based on images of contaminants from a plurality of pieces of laundry having different materials.

* * * * *